US005190388A

United States Patent [19]

Lee

[11] Patent Number: 5,190,388

[45] Date of Patent: Mar. 2, 1993

[54] WRITING INSTRUMENT WITH WATER LEVEL INDICATOR

[76] Inventor: Suk H. Lee, 7145 N. Hamlin, Lincolnwood, Ill. 60645

[21] Appl. No.: 608,824

[22] Filed: Nov. 5, 1990

[51] Int. Cl.[5] ..... B43K 29/00; B43K 29/08

[52] U.S. Cl. ..... 401/52; 401/195; 434/166; 40/334

[58] Field of Search ..... 401/52, 195; 40/334; 33/354; 434/85, 162, 166

[56] References Cited

U.S. PATENT DOCUMENTS

| | | | |
|---|---|---|---|
| 2,029,877 | 2/1936 | Knudsen | 40/334 |
| 2,215,084 | 9/1940 | Neal | 40/334 X |
| 2,237,883 | 4/1941 | Lipie | 40/334 |
| 2,251,640 | 8/1941 | Skrainka | 401/52 X |
| 2,591,874 | 4/1952 | Ritchie | 40/334 |
| 2,745,198 | 5/1956 | Nelson | 40/334 |
| 2,866,440 | 12/1958 | Green . | |

FOREIGN PATENT DOCUMENTS 217318 12/1909 Fed. Rep. of Germany .

*Primary Examiner*—Steven A. Bratlie

[57] ABSTRACT

A writing device including a means for observing and measuring the inclination of the device in order to teach proper penmanship to pupils using the device at a young and formidable age. The writing device includes an oil-filled vessel with lines imprinted thereon whereby the imprinted lines of a container match up with the angle of the oil at the optimum inclination at which to hold the writing instrument.

9 Claims, 1 Drawing Sheet

WRITING INSTRUMENT WITH WATER LEVEL INDICATOR

BACKGROUND OF THE INVENTION

This invention relates to a writing device that can be used in training a writing student to have the hand and writing instrument assume the correct angle for writing and remain in that correct position.

As has been stated in the Green patent, U.S. Pat. No. 2,866,440, previous devices proposed for the purpose of providing training for students of writing have included many complicated devices including those where the writing instrument includes finger guides and writing instrument guides and devices which are mainly writing instrument guides supported from a wristband on the operator but having the support under the palm to partially correct the position of the hand. The disadvantage of these types of devices is that they tend to be uncomfortable as well as to cramp the fingers and hand and also tend to make the learner not only depend too much on them, but to be unable to write without them.

Other proposed writing guides for the purpose are typified in U.S. Pat. No. 1,797,103 to Rustag and U.S. Pat. No. 2,501,552 to Thompson. These devices, too, have means for supporting the writing instrument by a member extending forwardly from the top of a wristband. In Green, U.S. Pat. No. 2,866,440, the device was of this type and it was claimed that it improved the previous ones in permitting greater freedom of the hand to turn sideways or to flex forwardly and rearwardly relative to the wrist while still urging a writing instrument into the proper angle relative to the writing surface. However, in reviewing these types of devices including Green, it can be seen that they are quite complicated in relying upon wristbands and mechanical contrivances to keep the hand of the writer in the appropriate position.

Thus, it is an object of my device to provide an improved writing device which does not rely on mechanical means such as the wristbands and rods of previous devices to train a writer; but rather relies on the writer visually observing the angle of inclination of the writing instrument by means of a liquid-filled compartment that has a variety of levels depending on the inclination at which the writing instrument is held.

It is further an object of this invention to provide a low-cost writing guide such as may be easily used by the child learning to write and such as will teach good writing habits without becoming a painful experience to the writer.

It is further an object of the invention to provide a writing device where the writer can occasionally change the position of the hand and still return to the optimum position of a, for instance, 52° angle by merely observing the oil level with respect to markings on the writing instrument.

It is further an object of the invention to teach a student how to hold a writing instrument at its optimum angle without binding the hand or making the hand uncomfortable by means of merely observing the visual level through employing a liquid-filled vessel to accomplish this.

It is still even further an object of this invention to provide an improved process for teaching good penmanship which includes as one of its steps visually observing and measuring the optimum angle at which a writing instrument is held and practicing writing by maintaining that angle, by visually observing the angle.

Other objects and advantages of the writing instrument will be apparent from the following description of the drawing wherein like characters of reference indicate corresponding parts:

DESCRIPTION OF THE PREFERRED EMBODIMENT

Figure 3:
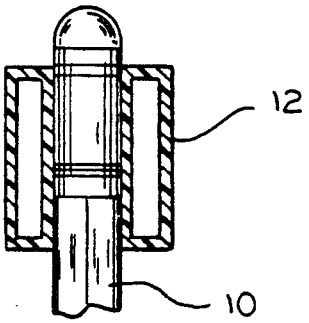
FIG. 3 is a sectional view taken on a plane passing through lines 3—3 and looking in the direction of the arrows.

Referring to the drawings wherein the preferred embodiment of the invention is shown, the writing instrument is a pencil 10 having the typical octagonal cross-section as seen in FIG. 3 whereby a transparent vessel 12 is associated with the pencil 10 by it being slipped through the aperture 14 thereof.

Figure 1:
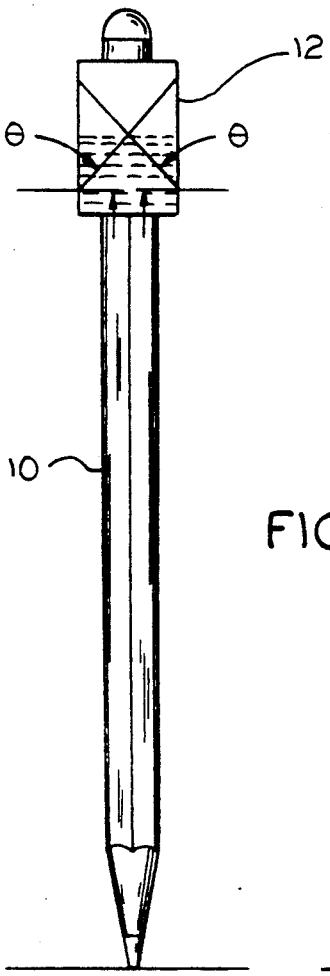
FIG. 1 is a side elevational view of a writing device to be used in the present invention where it is positioned vertically.
Figure 2:
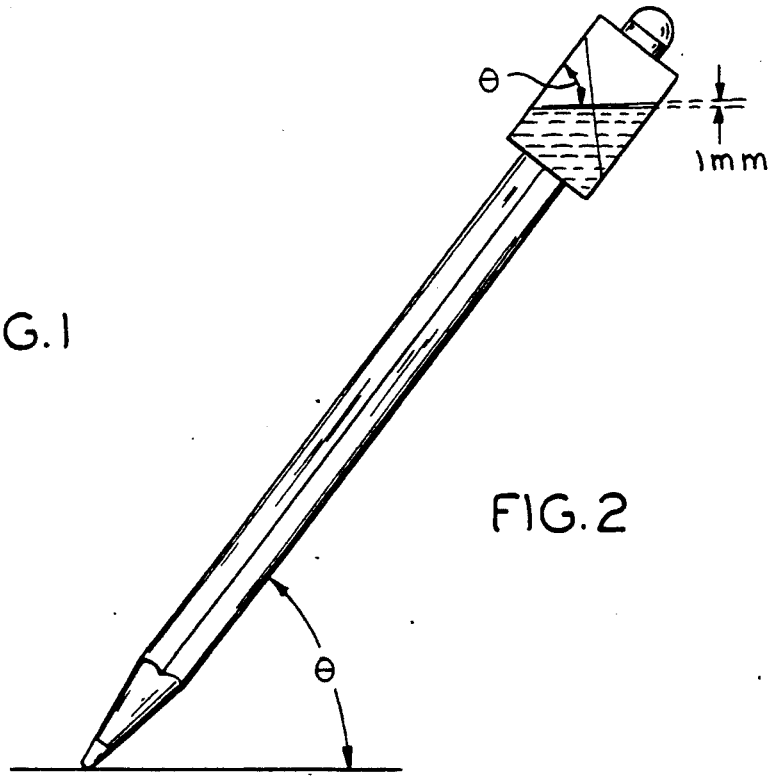
FIG. 2 is a side elevational view of the writing instrument where it is pictured as positioned on an angle.

For purposes of explaining this invention, the views of FIGS. 1 and 2 best illustrate what the invention primarily accomplishes. In FIG. 1, where the pencil and transparent vessel 12 are vertical, there are a pair of lines marked on each side of the vessel at the angle 0 with respect to the horizontal plane. Thus, for instance, where the angle 0 is equal to 52°, this is indicated as the desired, optimum angle at which it is best to hold the writing instrument. Referring to FIG. 2, we see that the angle 0, as indicated by the marking, is equal to the angle 0, and is coincident with the marking and is equal to the magnitude of the angle 0 or 52°, which is seen in FIG. 2.

The angle 0 can be a variety of angles within a range that is considered optimal. The optimum range as now believed preferably to be 52° to 55°, but this invention would apply to other angle magnitudes depending on what the educators believe.

As seen from the drawings, by having the markings on both sides of the transparent vessel 12 with the level of the oil being visible from both sides of the writing instrument and vessel, the vessel can enable both left-handed and righthanded students to learn to write in this improved manner.

Figure 4:
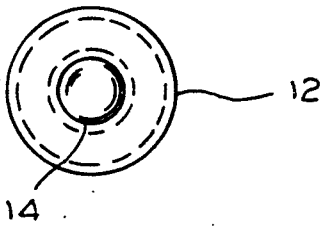
FIG. 4 is a sectional view taken on a plane passing through the lines 4—4 and looking in the direction of the arrows.

From the sectional views of FIGS. 3 and 4, it can be seen that the vessel has an opening 14 formed in the shape of a circle to receive a writing instrument therein of the same shape by merely slipping the writing instrument in. While the vessel is preferably made of a transparent plastic, other comparable transparent materials can be used. Once the writing instrument is fixedly associated with the vessel 12 it can be operated by a person learning to write without any of the constraints of previous inventions. All the operator needs to do is to position the pencil so that the angle 0 is equal to the angle of the inclination of the pencil. Once this inclination is obtained, the oil will be coincident with the marking which is shown in a horizontal position as seen in FIG. 2 or with one minute as indicated in this figure.

Other shapes of vessels are contemplated in order to be associated with other types of writing instruments. Further, the writing instruments can either have the vessels permanently attached thereto or they can be removably attached so that different writing instruments of the same shaped cross section can be used.

It is also apparent from understanding this invention that a new and improved process for teaching a writing pupil good penmanship is achieved: wherein a marked vessel having oil or the like therein is associated with a writing instrument and the pupil grips the pen and causes writing to occur by moving or maintaining the writing instrument at an angle that causes the liquid in the vessel to be coincident with the marking and thereby indicate that the user of the pencil is writing with the writing instrument at the preferred angle.

Other objects and advantages will become apparent from viewing the claims.

What is claimed is:

1. In a writing instrument for teaching a pupil good penmanship by training the pupil to hold the writing instrument at an optimum angle, the improvement comprising:

a transparent vessel associated therewith and having a liquid therein with a liquid level that varies with different positions that said writing instrument is held, said transparent vessel including a marking thereon that is inclined at the optimum writing angle at which said pupil should hold the writing instrument when writing, whereby said liquid level and said marking are visually coincident with one another when the pupil is writing with the writing instrument held at said optimum writing angle.

2. A transparent vessel whose purpose is to aid in teaching good penmanship through enabling holding the instrument at an optimum, angular position, containing a liquid whose liquid level is free to move to different angular levels in said vessel, said transparent vessel being associatable with a writing instrument and said different angular levels of said vessel are observable when said writing instrument is being used comprising:

a marking on said transparent vessel that indicates that said writing instrument is held at said optimum angular position when said liquid level is observable as being coincident with said marking, whereby penmanship can be achieved through using a writing instrument at said optimum angular position by merely visually observing whether said angular position of said liquid level and said marking are coincident with one another when said writing instrument is being held at said optimum angular position during writing.

3. The invention described in claim 2 wherein said transparent vessel has an opening therethrough that is of the same cross-sectional shape of the writing instrument, whereby said writing instrument can be associated with said transparent vessel by having the writing instrument inserted in said opening.

4. The invention described in claim 2 wherein said transparent vessel is fixedly attached to a writing instrument.

5. The invention described in claim 2 wherein said transparent vessel is removably attached to said writing instrument.

6. A transparent vessel, as defined in claim 2, wherein at least two markings are available that indicate the optimum angle for either a left- or right-handed writer.

7. A transparent vessel, as defined in claim 2, wherein said liquid is a viscous liquid such as oil.

8. A transparent vessel, as defined in claim 2, wherein said vessel is made of a plastic.

9. A process of teaching good penmanship using a writing instrument associated with a transparent vessel containing liquid that is free to move to different angular levels and at least one marking on said vessel where the liquid level and said marking are observable as being visually coincident when said writing instrument is positioned at the optimum angle at which one should hold said writing instrument for good penmanship comprising at least the steps of:

gripping said writing instrument and writing;

changing and/or maintaining the angle of the writing instrument to said optimum writing angle at which it is desirable to hold said writing instrument for good penmanship by attempting to have said marking and said liquid level in said vessel be visually coincident with each other while writing.

* * * * *